US008932050B2

(12) United States Patent
da Silva et al.

(10) Patent No.: US 8,932,050 B2
(45) Date of Patent: Jan. 13, 2015

(54) SUPPLY MEANS OF A ROTATING FURNACE USED FOR CALCINATION OF OIL GREEN COKE

(75) Inventors: Edinaldo Pereira da Silva, Cubatão/São Paulo (BR); Elcio Santana, Santos/São Paulo (BR); Manuel Lind Gomes, Santos/São Paulo (BR); Ivo Ribeiro da Rocha, São Vicente/São Paulo (BR); Genivaldo Linhares Brandão, Santos/São Paulo (BR)

(73) Assignee: Petrocoque S/A Indústria e Comércio, Cubatão/SP (BR)

( * ) Notice: Subject to any disclaimer, the term of this patent is extended or adjusted under 35 U.S.C. 154(b) by 615 days.

(21) Appl. No.: 12/807,985

(22) Filed: Sep. 16, 2010

(65) Prior Publication Data

US 2011/0065057 A1 Mar. 17, 2011

(30) Foreign Application Priority Data

Sep. 17, 2009 (BR) ..... 0904780

(51) Int. Cl.

| | |
|---|---|
| ***F27D 15/02*** | (2006.01) |
| ***F27D 9/00*** | (2006.01) |
| ***F27B 5/16*** | (2006.01) |
| ***F23K 3/06*** | (2006.01) |
| ***F27B 7/20*** | (2006.01) |
| ***F27B 7/10*** | (2006.01) |
| ***F27B 7/32*** | (2006.01) |

(52) U.S. Cl.

CPC ... *F27B 7/20* (2013.01); *F27B 7/10* (2013.01); *F27B 7/32* (2013.01)

USPC ..... 432/77; 165/61; 44/591; 44/607; 52/223.3

(58) Field of Classification Search

None

See application file for complete search history.

(56) References Cited

U.S. PATENT DOCUMENTS

| | | | | | |
|---|---|---|---|---|---|
| 1,620,989 | A | * | 3/1927 | Agthe | 432/115 |
| 2,026,441 | A | * | 12/1935 | Bernhard et al. | 432/74 |
| 2,036,578 | A | * | 4/1936 | Keyes | 432/2 |
| 2,160,956 | A | * | 6/1939 | Cheesman | 432/17 |
| 2,402,457 | A | * | 6/1946 | Smith | 414/149 |
| 2,813,822 | A | * | 11/1957 | Collier | 201/25 |
| 2,831,759 | A | * | 4/1958 | Osborn | 75/447 |
| 2,973,191 | A | * | 2/1961 | Sackett, Jr. | 432/108 |
| 3,006,816 | A | * | 10/1961 | Finney | 201/28 |
| 3,136,321 | A | * | 6/1964 | Davis | 131/371 |
| 3,362,857 | A | * | 1/1968 | Stewart | 148/513 |
| 3,511,643 | A | * | 5/1970 | Vallak Enn et al. | 75/500 |
| 3,514,280 | A | * | 5/1970 | Sherwood | 75/527 |
| 3,542,350 | A | * | 11/1970 | Sherwood | 266/213 |

(Continued)

*Primary Examiner* — Steven B McAllister
*Assistant Examiner* — Eric Gorman
(74) *Attorney, Agent, or Firm* — Collard & Roe, P.C.

(57) ABSTRACT

A system for calcination of oil green coke has a rotating furnace and a rotating cooler, the furnace being serviced by boiler, a combustion chamber and a chimney. There is a feeding system defined by a first mat carrying the green coke into a silo and another mat transporter to feed the furnace. At the end of the silo there are two discharge breadths for the oil green coke, where each breadth has two drawer-like feeders for feeding the green coke onto the mat transporter and, from this to the inside of the rotating furnace through a fall set.

2 Claims, 9 Drawing Sheets

(56) References Cited

U.S. PATENT DOCUMENTS

| | | | | | |
|---|---|---|---|---|---|
| 3,558,114 | A | * | 1/1971 | Saeman | 423/304 |
| 3,575,397 | A | * | 4/1971 | McDowell et al. | 432/115 |
| 3,814,406 | A | * | 6/1974 | Shimizu et al. | 266/173 |
| 3,920,381 | A | * | 11/1975 | Heinemann | 432/80 |
| 3,921,831 | A | * | 11/1975 | Takahashi et al. | 414/206 |
| 3,938,449 | A | * | 2/1976 | Frisz et al. | 110/345 |
| 3,950,143 | A | * | 4/1976 | Pyle | 44/500 |
| 4,092,094 | A | * | 5/1978 | Lingl, Jr. | 432/1 |
| 4,176,010 | A | * | 11/1979 | Dudek et al. | 201/27 |
| 4,198,273 | A | * | 4/1980 | Dudek et al. | 202/136 |
| 4,363,571 | A | * | 12/1982 | Jackson et al. | 406/56 |
| 4,400,154 | A | * | 8/1983 | Lientz | 432/115 |
| 4,405,137 | A | * | 9/1983 | Webb | 277/553 |
| 4,454,827 | A | * | 6/1984 | Smith et al. | 110/234 |
| 4,494,984 | A | * | 1/1985 | Calderon | 75/10.15 |
| 4,502,702 | A | * | 3/1985 | Nixon, Jr. | 277/545 |
| 4,543,061 | A | * | 9/1985 | Edwards | 432/115 |
| 4,572,086 | A | * | 2/1986 | Ladt et al. | 110/347 |
| 4,588,429 | A | * | 5/1986 | Hohman et al. | 65/27 |
| 4,630,975 | A | * | 12/1986 | Becker | 406/85 |
| 4,724,777 | A | * | 2/1988 | Reed et al. | 110/246 |
| 4,846,053 | A | * | 7/1989 | Lane et al. | 99/339 |
| 4,943,367 | A | * | 7/1990 | Nixon et al. | 208/131 |
| 4,961,588 | A | * | 10/1990 | Brienza | 277/545 |
| 5,028,299 | A | * | 7/1991 | Guidat et al. | 162/24 |
| 5,258,101 | A | * | 11/1993 | Breu | 202/131 |
| 5,422,861 | A | * | 6/1995 | Stringer et al. | 367/99 |
| 5,476,990 | A | * | 12/1995 | Hittner et al. | 588/314 |
| 5,543,061 | A | * | 8/1996 | Baskis | 210/774 |
| 5,555,823 | A | * | 9/1996 | Davenport | 110/346 |
| 5,571,269 | A | * | 11/1996 | Buelow | 277/545 |
| 5,606,534 | A | * | 2/1997 | Stringer et al. | 367/128 |
| 5,616,296 | A | * | 4/1997 | Hittner et al. | 266/145 |
| 5,642,601 | A | * | 7/1997 | Thompson et al. | 53/431 |
| 5,711,018 | A | * | 1/1998 | Hittner et al. | 588/314 |
| 5,850,370 | A | * | 12/1998 | Stringer et al. | 367/128 |
| 5,855,742 | A | * | 1/1999 | Lumbroso et al. | 202/241 |
| 5,913,677 | A | * | 6/1999 | Von Beckmann | 432/13 |
| 6,013,158 | A | * | 1/2000 | Wootten | 202/99 |
| 6,064,629 | A | * | 5/2000 | Stringer et al. | 367/128 |
| 6,171,499 | B1 | * | 1/2001 | Bouchalat | 210/603 |
| 6,298,009 | B1 | * | 10/2001 | Stringer | 367/99 |
| 6,470,812 | B1 | * | 10/2002 | Arroyave-Garcia et al. | 110/346 |
| 7,384,181 | B1 | * | 6/2008 | Collette | 366/7 |
| 7,686,612 | B1 | * | 3/2010 | Buteau | 432/115 |
| 7,993,048 | B1 | * | 8/2011 | Collette et al. | 366/7 |
| 2002/0082802 | A1 | * | 6/2002 | Stringer et al. | 702/159 |
| 2002/0134550 | A1 | * | 9/2002 | Leeson et al. | 166/266 |
| 2003/0024806 | A1 | * | 2/2003 | Foret | 204/164 |
| 2003/0164235 | A1 | * | 9/2003 | Leeson et al. | 166/266 |
| 2005/0051066 | A1 | * | 3/2005 | May et al. | 110/345 |
| 2005/0166810 | A1 | * | 8/2005 | Gnedenko et al. | 110/342 |
| 2006/0096837 | A1 | * | 5/2006 | Sanders | 198/525 |
| 2006/0107587 | A1 | * | 5/2006 | Bullinger et al. | 44/629 |
| 2006/0169181 | A1 | * | 8/2006 | Youn et al. | 106/740 |
| 2007/0007198 | A1 | * | 1/2007 | Balvanz | 210/512.1 |
| 2007/0227874 | A1 | * | 10/2007 | Wolf-Eberhard et al. | 202/84 |
| 2008/0072806 | A1 | * | 3/2008 | Kimberlin et al. | 110/346 |
| 2008/0201980 | A1 | * | 8/2008 | Bullinger et al. | 34/493 |
| 2008/0209807 | A1 | * | 9/2008 | Tsangaris et al. | 48/89 |
| 2008/0210089 | A1 | * | 9/2008 | Tsangaris et al. | 95/90 |
| 2009/0236766 | A1 | * | 9/2009 | Rust et al. | 264/141 |
| 2010/0141013 | A1 | * | 6/2010 | Lahr | 299/16 |
| 2010/0275781 | A1 | * | 11/2010 | Tsangaris et al. | 96/108 |
| 2011/0036014 | A1 | * | 2/2011 | Tsangaris et al. | 48/62 R |
| 2011/0065059 | A1 | * | 3/2011 | Brandao et al. | 432/115 |
| 2012/0067789 | A1 | * | 3/2012 | Bullinger et al. | 209/133 |
| 2013/0133560 | A1 | * | 5/2013 | Laskowski et al. | 110/190 |
| 2014/0141381 | A1 | * | 5/2014 | Bullinger et al. | 432/29 |

* cited by examiner

SUPPLY MEANS OF A ROTATING FURNACE USED FOR CALCINATION OF OIL GREEN COKE

CROSS REFERENCE TO RELATED APPLICATION

Applicants claim priority under 35 U.S.C. section.119 of Brazilian Application No. PI 090.4780-8 filed Sep. 17, 2009.

BACKGROUND OF THE INVENTION

More specifically, this Invention has as its most important characteristic the form and innovative methods without mobile parts for the green coke to be introduced by a substantially continuous flow and by a simple free fall on the entrance spot of a rotating furnace, so that inside the rotating furnace the calcination can take place.

Currently, the green coke feeding at the entrance or initial end of the rotating furnace is made through mobile parts traditionally known as "scoop feeder", where a component rotates concentrically with the rotating furnace and performs the role of a scoop transporter, so that the coke falling from a transporting mat can be collected in continuous dosages (scoops) and, thereon, it is unloaded in a controlled and homogeneous form to the initial part of the collective furnace.

There is no doubt that the technology of the status of technique presents means for the green coke of the oil to feed properly a rotating furnace; however, along the years it has become noticeable that this technology could be changed, not only with the aim of improving the coke's calcinating process, but also with the aim of speeding up the process and reduce its cost, especially regarding construction and any maintenance, both preventive and corrective.

SUMMARY OF THE INVENTION

In light of circumstances above and aiming at overcoming them, this invention was created to, in general lines, be a new constructive concept specially created to eliminate the mobile parts inside the furnace, meaning: replace the traditional "scoop feeder" system for a feeding set without any mobile parts; in addition, this set, unlike the usual, has no parts assembled to the peripherals of the rotating furnace, consequentially releasing and making productive this area which was previously occupied by the conventional device used for the same purpose, thus providing for substantial technical and practical advantages, such as: stability of the coke bed in the inside of the calcinating furnace; increased useful length of the furnace, and consequentially an increased time for residence of the material within the calcinator; reduced heating rate; reduced particulate material dragged; reduced maintenance items; and reduced reflux of green coke inside the calcinator.

BRIEF DESCRIPTION OF DRAWINGS

This invention and its advantages, as well as the previous techniques, will be better understood through the detailed description which is made below, together with the attached drawings.

DETAILED DESCRIPTION OF THE INVENTION

As it is well known to the ones familiar with this technique, the calcinated oil coke is an important input used for the production of primary aluminum, and thus is intended to carry the electric current for the electrolytic reaction of alumina dissociation for the aluminum production. Most of the production of oil calcinated coke in the world is made by rotating furnaces.

Figure 1:
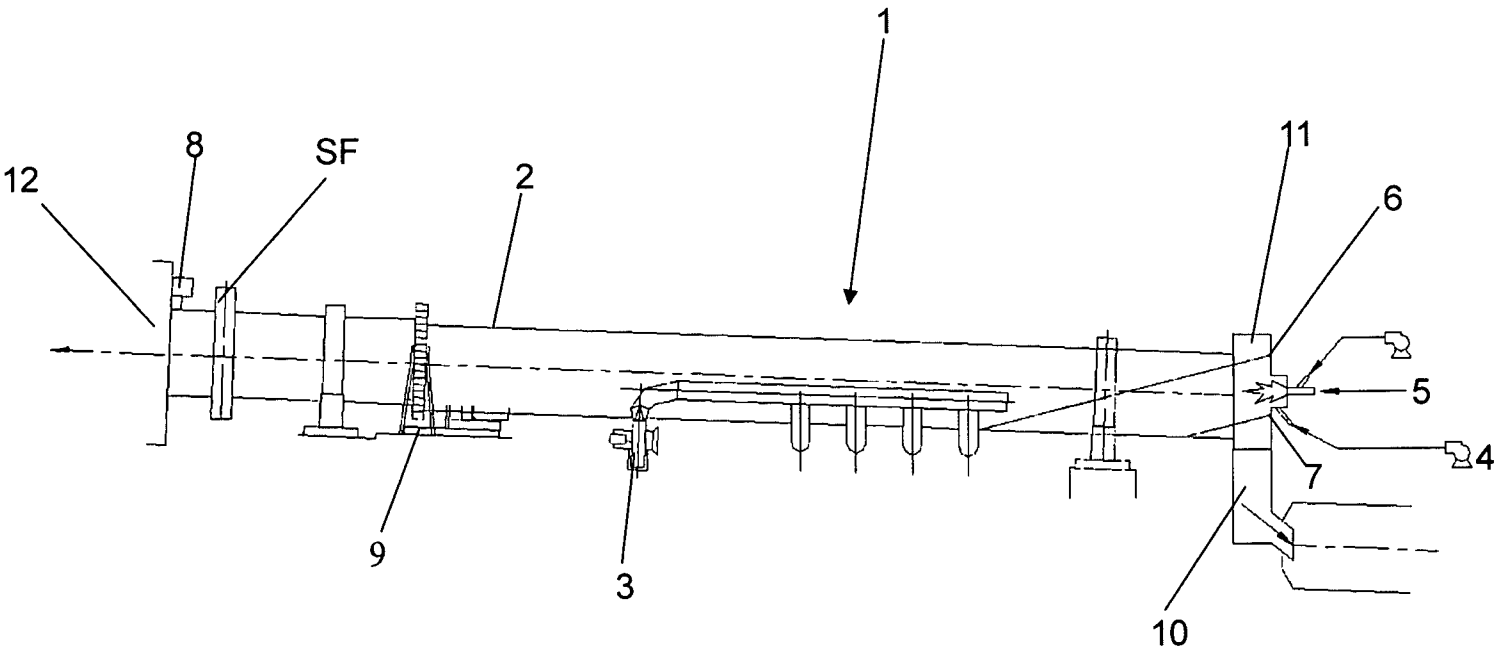
FIG. 1 is a schematic side view of a calcinating rotating furnace of oil coke.

FIG. 1 provides a scheme of a typical furnace used for the calcination of oil cokes. The rotating furnace (1) comprises the following basic parts: rotating cylinder (2) horizontally mounted and internally refracted, having also a certain slope angle; air blowers (3), called tertiary air which is aimed at the injection of atmospheric air to the calcinating zone of the coke, where temperature varies from 1300 to 1400.degree. C.; fans (4) mounted on the external zone of the furnace, close to the material discharge called head blowers, aimed at the cooling of the discharge head of the furnace; burner (5) mounted on the furnace discharge for use, on the unit start-up or resuming; measuring system by optical pyrometry (6-7) of temperatures of the calcinating and discharging zones; thermocouple 8 for measuring the temperature of furnace gases outlet; and (9) drive system composed of crown, pinion, gearing and engine for providing the circular movement of the furnace or its rotating cylinder (2), of which the lower end with the discharge breadth (10) constitutes the fixed part (11); consequentially, the opposed side, the higher side, constitutes the other fixed point (12), at which is installed the traditional "scoop feeder" (SF) feeding system, to be detailed below.

Figure 2:
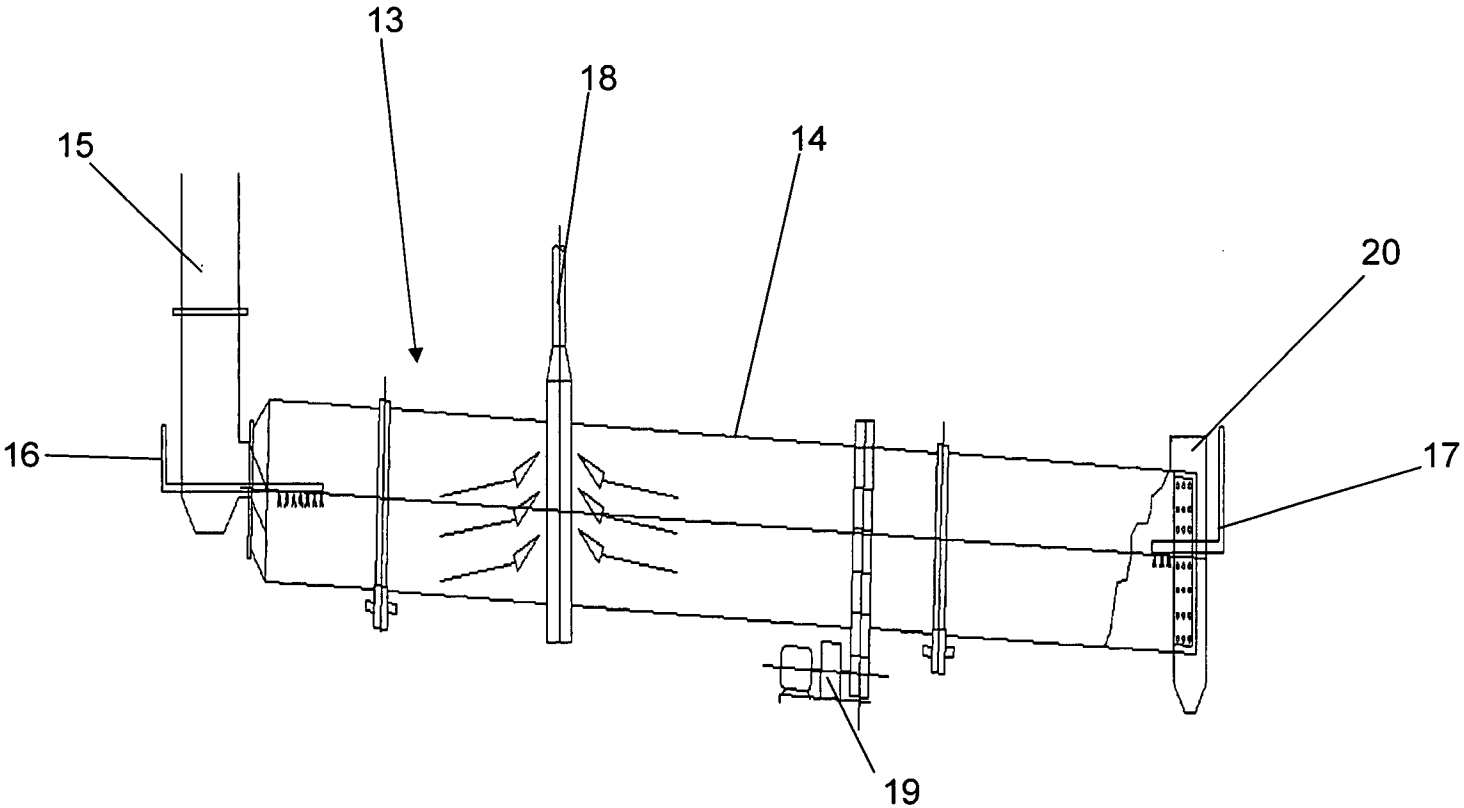
FIG. 2 shows another schematic view, but of a rotating cooler of oil calcinating coke.

After the calcinating process, the coke is discharged through the discharge breadth (10) into a rotating cooler (13), schematically mounted in FIG. 2, where it can be seen that it has a rotating cylindrical body (14) which, through one end, has the product entrance (15) and the entrance of extinguishing water (16) and, through the other end, has also the entrance of water (17), however for emergency, being that, along the cylindrical body there is also an unit of impounding of vapor air (18) and driving or rotating unit (19). Thus, by means of water jets, the calcinated coke temperature is lowered from 1100.degree. C. to 110.degree. C.; right after the cooling, the calcinated coke goes to the storage in silos and subsequent remittance to the aluminum market. The rotating cooler (13) also presents a fixed part (20) in its lower and outlet position of the cooled coke.

In counterflow to the coke inside the calcinator there is a large gaseous mass, composed of several substances resulting from the cracking of volatile material in the green coke, humidity, dragged sharps and air injected inside the calcinator.

The release of humidity and heating of the coke takes place in the range of 25 to 400.degree. C., and the devolatization takes place in the range of 500 to 1000.degree. C.; the coke densification and burn of a small quantity of carbon takes place between 1200 and 1400.degree. C.

The sharps dragged during the process are considered as a subproduct of low added value, and their generation and transport depend on several associated factors during the calcination.

Figure 3:
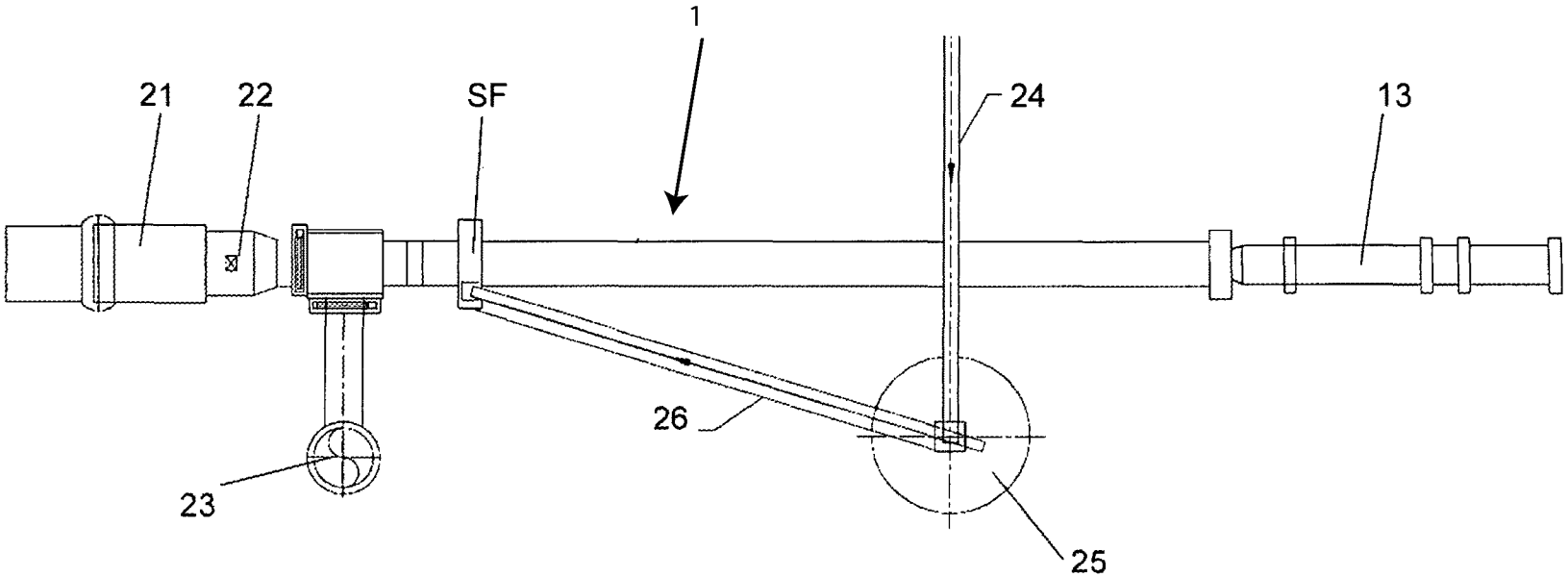
FIG. 3 represents a schematic plant of a facility to calcinate oil green coke.
Figure 4:
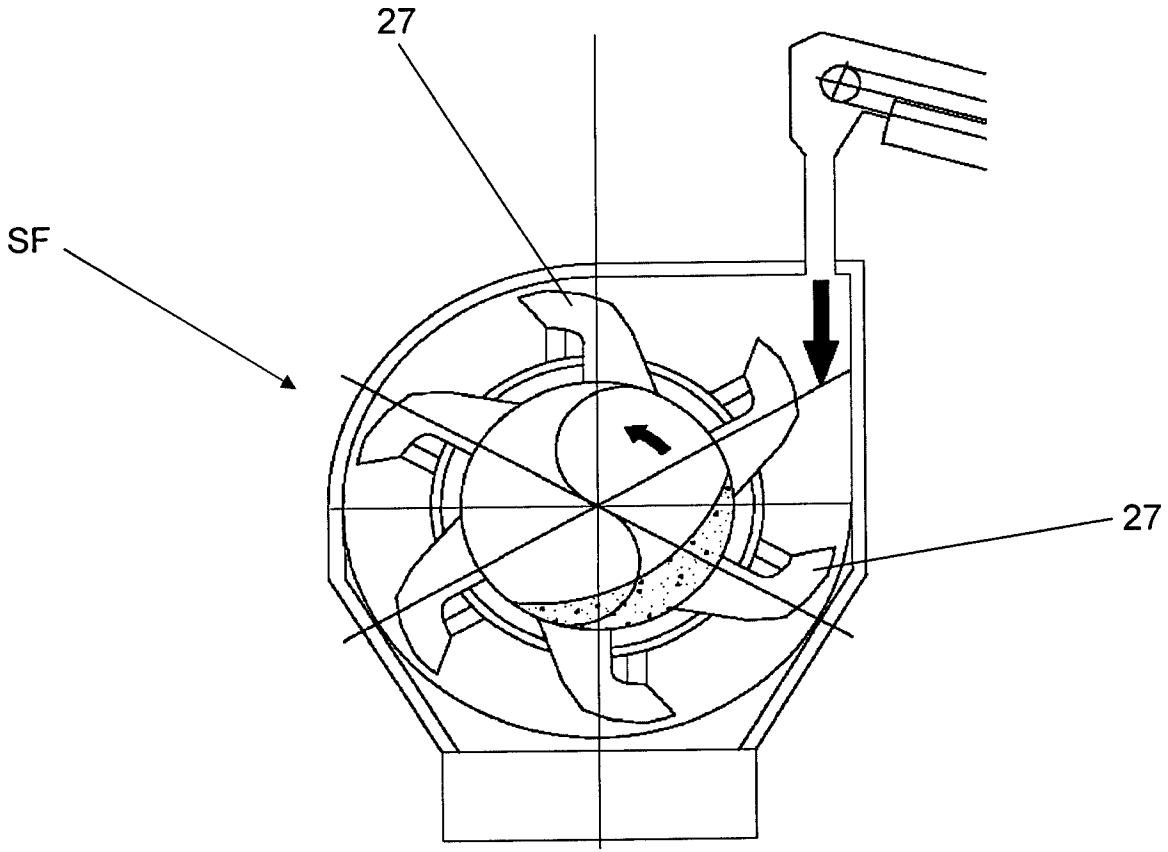
FIG. 4 is a schematic view showing the traditional scoop feeder, the set used for feeding the green coke inside the rotating furnace.

Therefore, the furnace (1) and the cooler (13) are apart of a system to calcinate the green coke of oil. This system is generically illustrated in FIG. 3, where we can verify the two units coupled in line and also the furnace (1) preceded by the boiler (21), the combustion chamber (22) and the respective chimney (23), as well as the integration to a conventional feeding system which, in addition to scoop feeders, includes a first mat or belt conveyor (24) to conduce the green coke into a silo (25); at the outlet of the silo, there is another mat transporter or belt conveyor (26) for feeding until the referred scoop feeder (SF). At the outlet of the silo (25) there are two discharge breadths or chutes of oil green coke, where each breadth or chute has two drawer feeders unloading the green coke to the mat transporter (26), assembled on the side of the calcinating furnace. At the discharge chute of the mat transporter (26), the material is introduced to the scoop feeder (SF), which can be seen with details in FIG. 4; this would be a kind of set of collector shovels or scoops (27) directly mounted to the interior of the initial end of the furnace (1). In this sample case, the scoop feeder (SF) has 6 equidistant shovels with the rotating movement of the calcinating furnace; on one side, the material is collected by the shovels in regular quantities; on the other side, simultaneously, this material is equally discharged to the interior of the furnace (over the wall). From this point on, the green coke moves in a peculiar way, ordinarily in helical form, due to the rotation and inclination of the furnace. It can be seen that the internal length of the furnace the one used for different stages of calcination, is extremely important.

Figure 6:
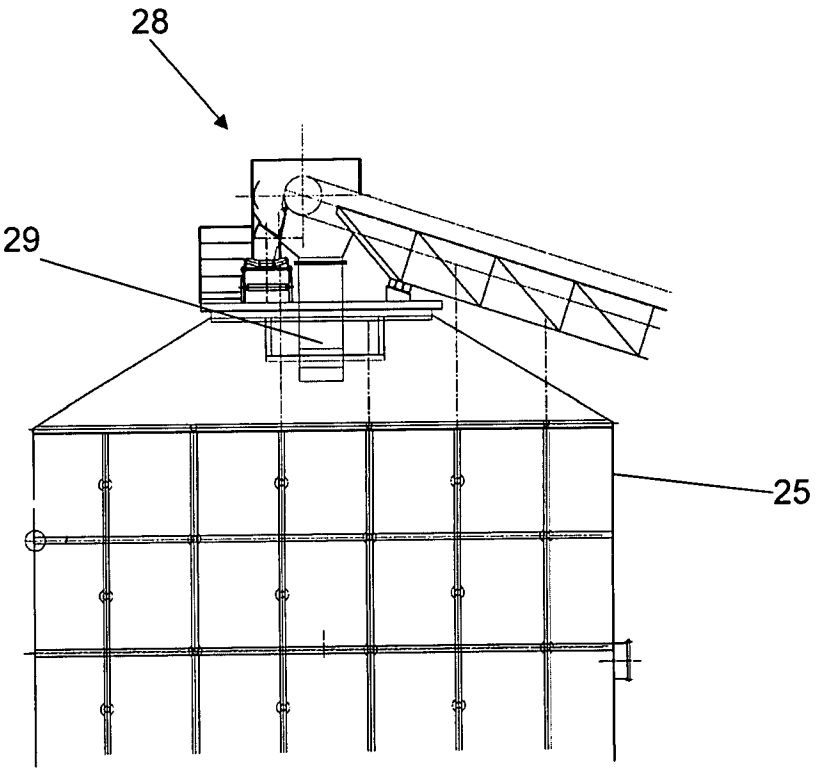
FIGS. 5, 6, 7 and 8 are different side views and enlarged details, especially the details of the storage silo of the oil green coke.
Figure 5:
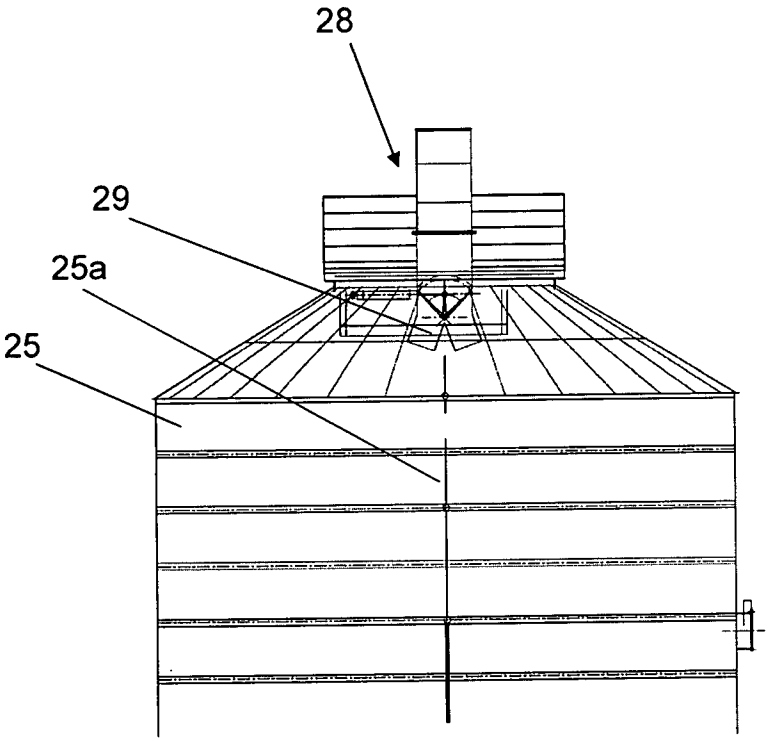

The improvements made comprise the whole sets involved in the feeding system of the coke until the silo (25) interior and until the interior of the rotating furnace (1), meaning: feed mat (24) of the silo (25); silo (25) which can be a green coke silo; removal of the material from the silo (25), transportation (26) of the green coke until the rotating furnace (1), green coke discharging system in the interior of the rotating furnace (1) and (f) draggers of green coke inside the calcinating furnace;

As per illustrated by FIGS. 5 and 6, a first change includes constructive details in the superior part of the silo (25), where the entrance of feeding is defined by a chute (28), which, through the higher part, presents the flexibility for directing the supplied material in two opposed sides. This modification provides an operational advantage during the feeding operations in sides north and south of the silo (25).

Still regarding FIGS. 5 and 6, other changes made to the green coke silo have different purposes, where the first one is the operational flexibility for working with raw material of different qualitative characteristics, which was reached equipping the chute (28) with an outlet inferior septum (29) which, together with a division wall (25*a*), configuring thus a cooperative division for receiving the raw materials (oil green coke) of different qualities and/or sources.

The walls of the silo (25) received longitudinal bars for structural reinforcement of the silo, with the aim of supporting the load levels.

Figure 7:
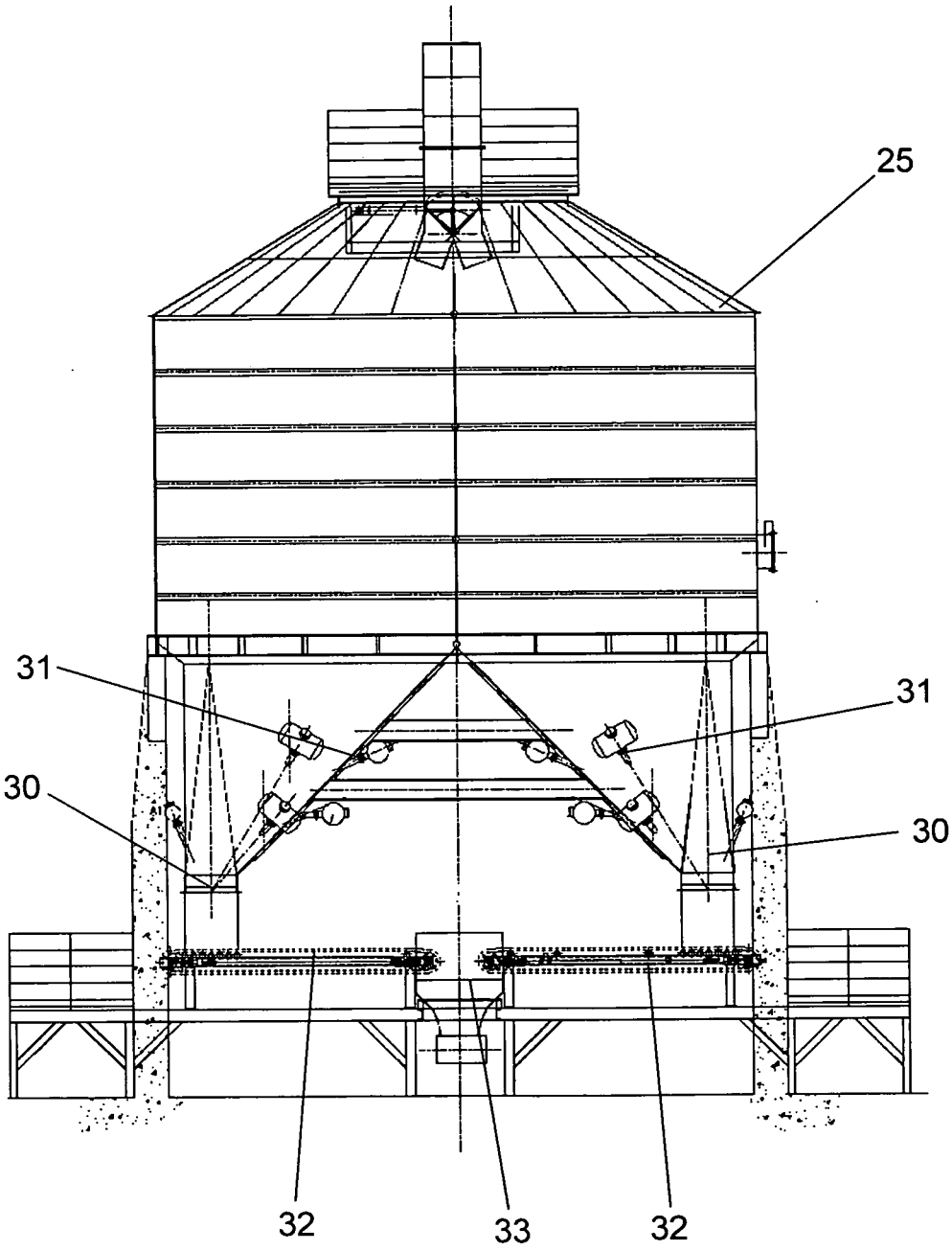
Figure 8:
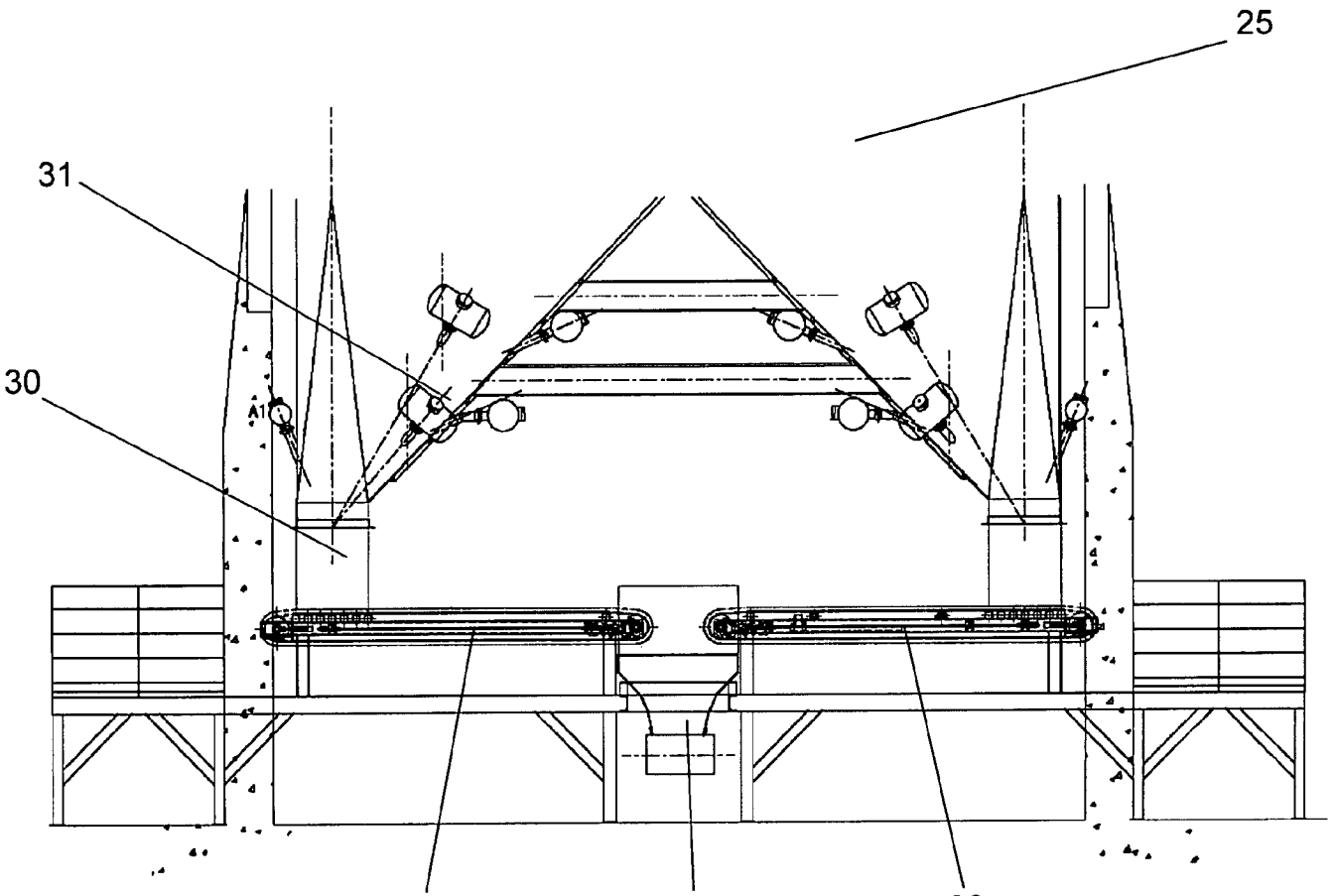

As per illustrated in FIGS. 7 and 8, the lower part of the silo (25) has two integrated discharge breadths of opposing discharge nozzles (30), equally equipped with pneumatic rammers (31), as well as the said opening with modified angles cooperating for the material to have the proper flow, since under each discharge breadth of opposing discharge nozzles (30) there is a mat transporter with a dynamic weighing device for load control (32), one aligned to the other, so that both can be laid in a discharge breadth of an intermediate nozzle (33). This system allows for a proper stability of the load which will be added to the calcinating furnace.

Figure 9:
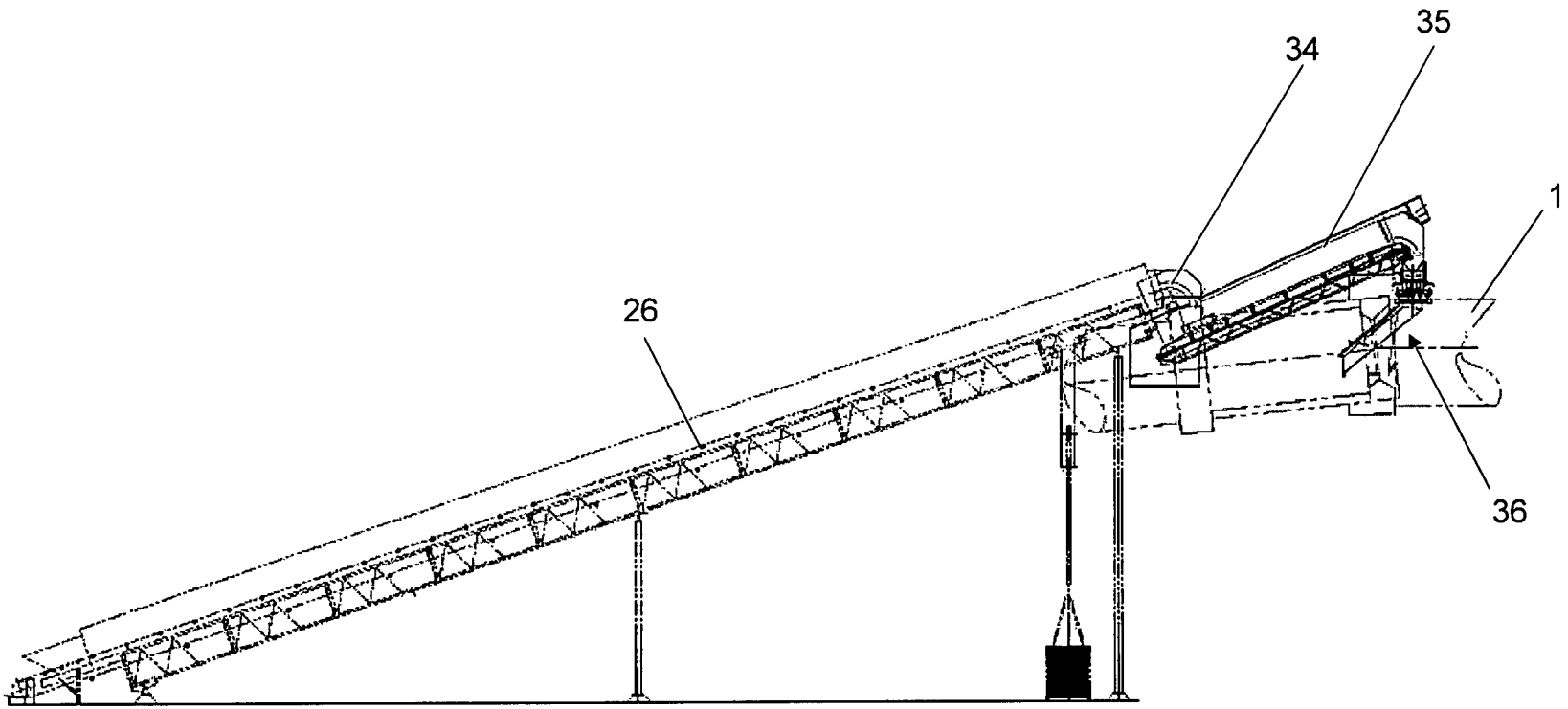
FIGS. 9, 10 and 11 show views detailing the assembly of different sets of transportation of the green coke until the entrance of the calcinating rotating furnace.

Under the discharge breadth of an intermediate nozzle (33), such as illustrated by FIG. 9, the end corresponding to the mat transporter (26) is positioned, of which the outlet (34) is coupled to a transporting complement feeding set (35), which, for its turn, unloads the green coke in a last feeding set defined as fall set (36).

With the introduction of the fall set to the interior of the calcinating rotating furnace (1), the need of extension of the current mat transporter was evident, but since this was not possible, a second transporter was placed at the main unloading point of the mat transporter, and this to unload from the feeding set (35) at last on the fall set (36).

Figure 10:
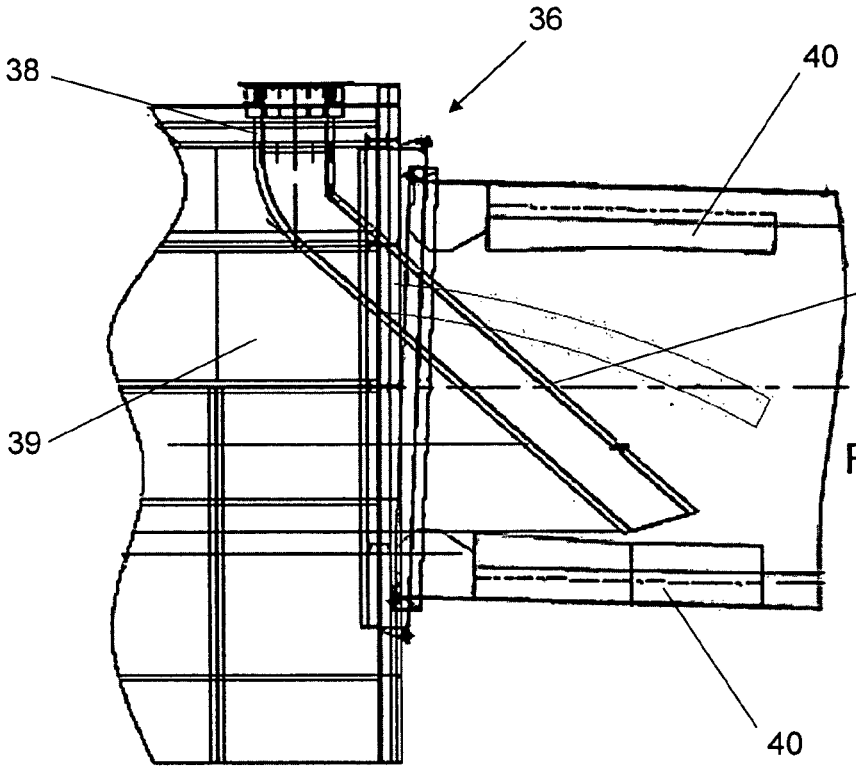
Figure 11:
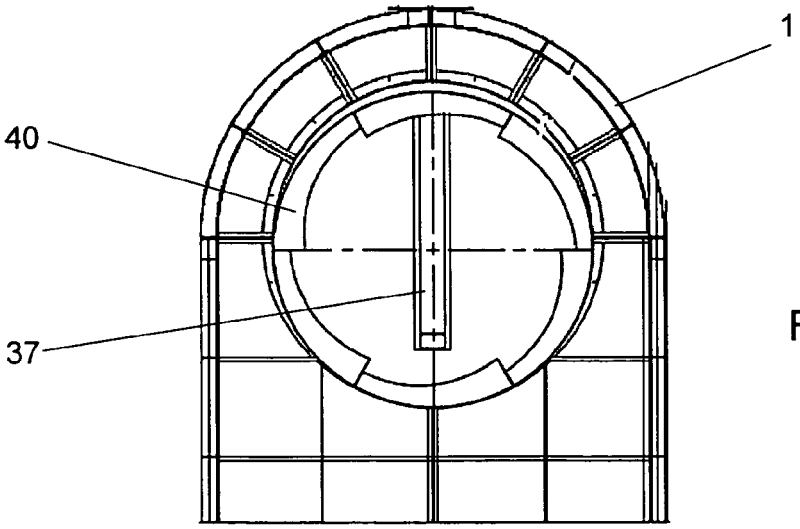

The fall set (36) is illustrated with details in FIGS. 10 and 11. This set is one of the innovative characteristics in the system, with the removal of the old scoop feeder (SF), which was replaced by a free fall tube (37) resistant to high temperatures, having a first superior part preferentially vertical (38), of which the superior end includes means to be coupled to the feeding set (35), being that this first straight part (38) is positioned on any fixed part (39) beside the superior side of the breadth or at the beginning of the rotating furnace (1), being then on the outside of the referred furnace; however, the inferior part of the fall tube (37) presents a long part of its length substantially inclined to the inside of the rotating furnace (1), where its inferior end is substantially close to the lowest part of the internal diameter of the referred rotating furnace (1) which, at this point, presents an initial part of its internal diameter equipped with several dragging wings (40), which are slightly bent and equidistant.

The material discharge fall tube (37) presents that angle and dimensions allowing for a proper unloading of the material to the inside of the rotating furnace (1), providing a low loss of load on the gas side and a minimum solid reflux inside the rotating furnace (1). The dragging wings (40) are naturally the main components for eliminating the coke reflux in a contrary direction to the rotating furnace (1) inclination, since they are combined with the fall tube (37) to characterize an uniform unloading, followed by a equally uniform movement, pushing the material to the front of the fall tube.

With the improvements of this invention, several technical and practical advantages are obtained, both in the functioning of the set and in the calcination process of the oil green coke. Such advantages in general overcome the conventional systems, which have no means to increase the length of the calcinating furnace; this is not a problem for this invention, where the introduced improvements allowed for a significantly better functioning and installation process, since with the removal of the scoop feeder system, a series of advantageous improvements was observed, such as: a) when the scoop feeder was removed, it was possible to significantly increase the useful length of the rotating furnace and consequentially improve the time during which the material stays inside the furnace, allowing for gains in the calcination process, especially regarding quality, speed and quantity of the processed material, all of which also contributed to a reduced power consumption; b) stability of the coke bed inside the calcinating furnace; c) reduced heating rate; d) reduced dragging of particulate material; e) considerable reduced maintenance procedures, whether both preventive and corrective, since there was a strong reduction of components; and f) reduced reflux of green coke inside the calcinator, It will be understood that certain characteristics and combinations of constructive details of the furnace, the cooler, the silo, as well as mat transport units may radically vary, maintaining the same functional concept for the calcination process of the green coke, and thus we can observe that the construction described in details for example of the whole set are clearly subject to constructive variations; however, always within the scope of the inventive scope hereunder of a feeding system with the breadth or entrance end of the rotating furnace defined by a fall tube and dragging winds, completely eliminating the old scoop feeder system; and since many changes can be made to the configuration detailed hereunder according to requirements of the law, it is understood that details hereunder should be interpreted in illustrative and not limiting manner.

What is claimed is:

1. A system for calcination of oil green coke, comprising:

a rotating furnace comprising:

a rotating cylinder, air blowers, fans, a burner, a measuring system that uses optical pyrometry to measure a temperature of a calcinating and discharge zone, a thermocouple for measuring an outlet temperature of gases from the rotating furnace, and a drive system composed of a crown, a pinion, gearing and an engine for providing circular movement of the rotating furnace or its cylindrical body, wherein a lower end of the rotating furnace having a discharge outlet that constitutes a fixed part and an opposed and highest side constitutes another fixed part;

a rotating cooler coupled to the rotating furnace, said rotating cooler having a cylindrical rotating body which, at one end, has a product entrance and extinguishing water entrance, and, at another end another water entrance, said cooler having a vapor air collection unit and a rotation drive unit;

a boiler;

a combustion chamber;

a chimney; and a feeding system connected to the chimney and comprising a silo having a first chute, a first belt conveyor for carrying the green coke into the silo and a second belt conveyor at an outlet of the silo for transportation to the rotating furnace, a third belt conveyor receivingly coupled to the second belt conveyor;

a second chute receivingly coupled to the third belt conveyor;

wherein said second chute is coupled to said rotating furnace, wherein said rotating furnace comprises a plurality of dragging wings which are bent;

wherein said first chute directs supplied material to two opposite sides such that an exit of the first chute is formed by a septum having a division wall, for receiving raw material of several qualities and sources;

wherein a lower part of the silo has two integrated discharge outlets, each equipped with pneumatic rammers, and an opening with modified angles to ensure flow of the raw material, a plurality of dynamic weighing belt conveyors with a dynamic weighing device for load control is disposed under each discharge outlet, aligned with each other, wherein a central discharge chute of the silo is positioned over an end of the second belt conveyor, said second belt conveyor being coupled to said third belt conveyor which unloads the green coke into said second chute;

wherein a top of the silo comprises said first chute which provides a means for flexible routing of the material stocked at two opposite sides and, therefore, said first chute has its output defined by said septum which together with said division wall provides a means for receiving green coke of different qualities and different sources.

2. The system according to claim 1, wherein said second chute has a high-temperature resistant free fall tube with a first vertical superior part having an end that is adapted to be coupled to the third belt conveyor, a first straight part positioned on a fixed part beside a superior side of said discharge outlet of the rotating furnace or at an outside of the rotating furnace, wherein an inferior part of the second chute is inclined toward an inside of the rotating furnace, and ends near a lowest part of the rotating furnace.

* * * * *